United States Patent [19]

Gregory et al.

[11] 4,108,708

[45] Aug. 22, 1978

[54] SCRIM MACHINE

[75] Inventors: Wallace D. Gregory; James R. Moore, both of Inman, S.C.

[73] Assignee: Milliken Research Corporation, Spartanburg, S.C.

[21] Appl. No.: 812,061

[22] Filed: Jul. 1, 1977

Related U.S. Application Data

[63] Continuation of Ser. No. 539,790, Jan. 9, 1975, abandoned, which is a continuation-in-part of Ser. No. 405,055, Oct. 10, 1973, abandoned.

[51] Int. Cl.[2] ..... B32B 31/12

[52] U.S. Cl. ..... 156/441; 28/101; 250/562; 250/563; 356/238

[58] Field of Search ..... 156/166, 180, 181, 350, 156/352, 440, 441; 28/1 CL; 356/237, 238; 250/561, 562, 559, 563

[56] References Cited

U.S. PATENT DOCUMENTS

| | | | |
|---|---|---|---|
| 3,099,829 | 7/1963 | Namenyi-Katz | 250/562 |
| 3,139,911 | 7/1964 | Breitmeier | 356/238 |
| 3,158,852 | 11/1964 | Schacher | 250/561 |
| 3,334,234 | 8/1967 | Taylor | 250/561 |
| 3,345,812 | 10/1967 | Pickering | 250/561 |
| 3,608,164 | 9/1971 | Bolles | 156/441 |
| 3,643,300 | 2/1972 | Seguin | 156/441 |
| 3,646,647 | 3/1972 | Klein | 156/441 |

*Primary Examiner*—William A. Powell
*Assistant Examiner*—John E. Kittle
*Attorney, Agent, or Firm*—Earle R. Marden; H. William Petry

[57] ABSTRACT

A method and machine to produce a scrim fabric which encompasses the use of a weft stop motion control to automatically stop the operation of the machine upon the detection of a broken weft yarn.

5 Claims, 5 Drawing Figures

SCRIM MACHINE

This is a continuation of application Ser. No. 539,790 filed Jan. 9, 1975 now abandoned, which is a continuation-in-part of application, Ser. No. 405,055 filed Oct. 10, 1973, now abandoned.

It is an object of this invention to provide a double weft machine which will more efficiently produce a non-woven fabric.

Other objects and advantages of the invention will become clearly apparent as the specification proceeds to describe the invention with reference to the accompanying drawings, in which.

Figure 1:
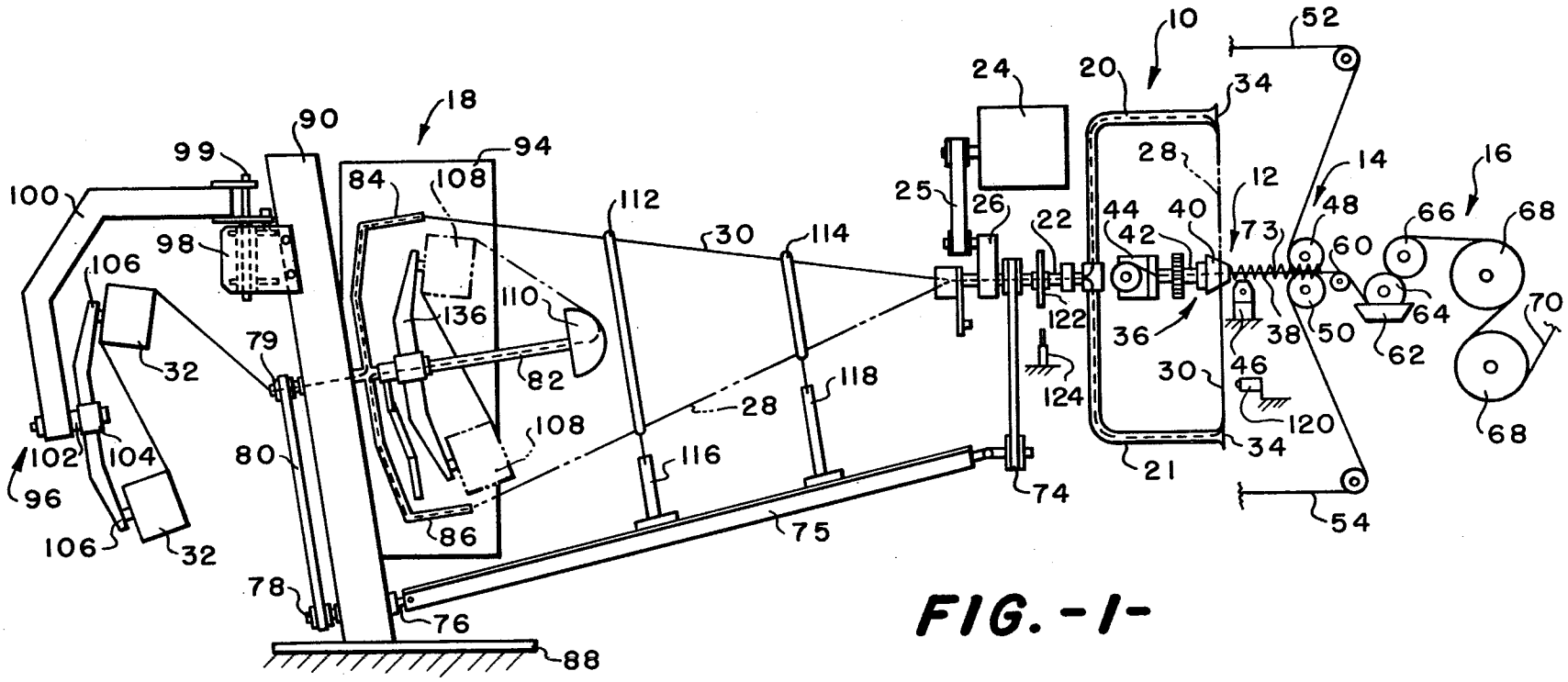
FIG. 1 is an overall schematic view of the new improved machine.
Figure 2:
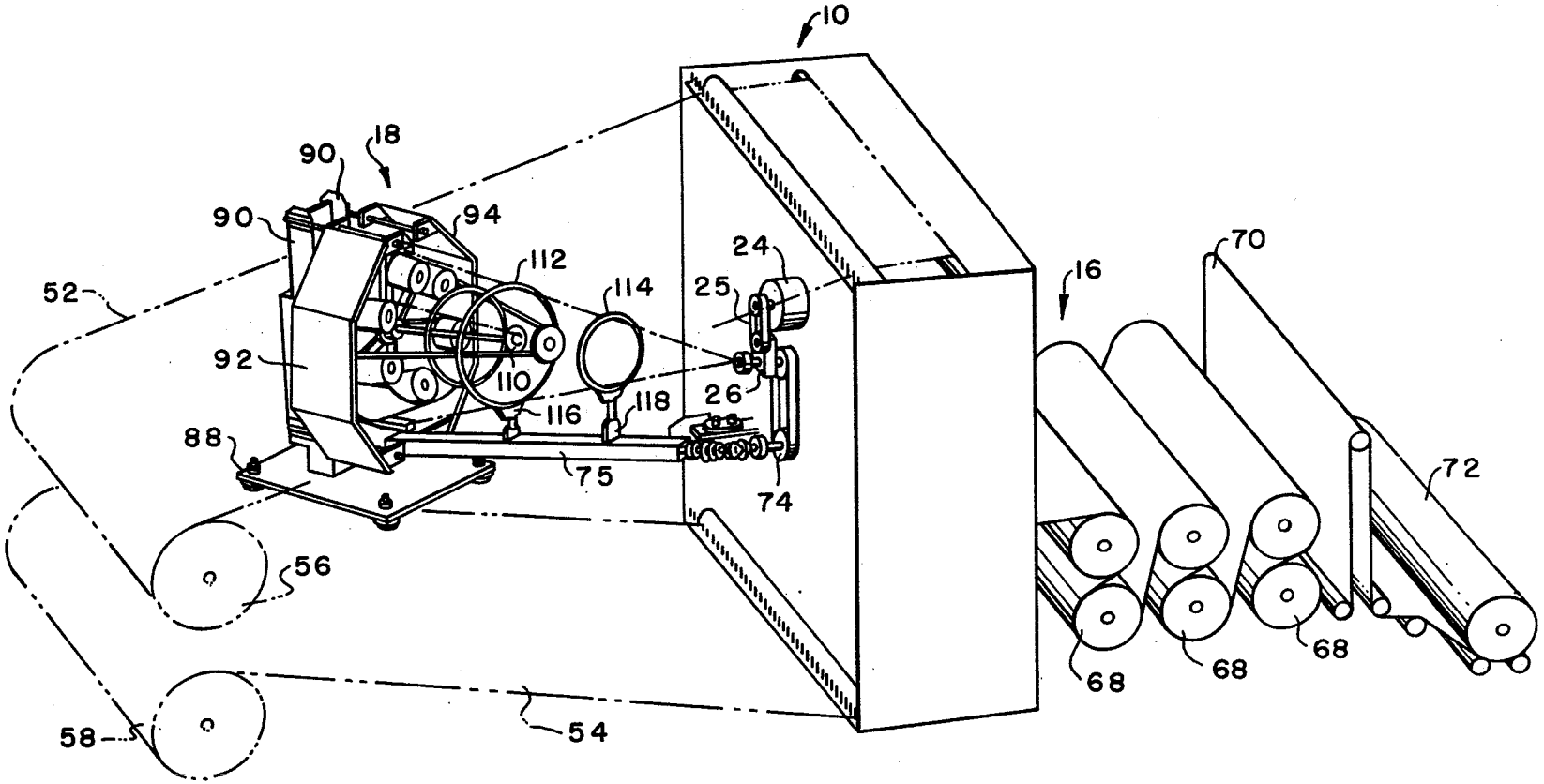
FIG. 2 is a schematic view like FIG. 1 showing the offset relationship of the weft yarn package support.

Referring now more particularly to the drawings and in particular to FIGS. 1 and 2, an apparatus is shown for continuously forming non-woven net fabrics which generally includes a thread winding section 10, a weft sheet forming section 12, a warp and weft sheet combining section 14, a section 16 for securing the sheets in contiguous coplanar relation to form a non-woven net fabric and a creel section 18.

As shown in FIGS. 1 and 2, thread winding section 10 includes thread winding means comprising a pair of hollow tubular thread guide arms 20 and 21 secured to a hollow central shaft 22 for rotation therewith. Shaft 22 is suitably supported for rotation about its central axis and is rotably driven by motor 24 through endless belt 25 and gear box 26. During rotation of thread guide arms 20 and 21 continuous threads or weft yarns 28 and 30 are continuously passed from the creel section 18 and yarn package 32, respectively, through the hollow shaft 22 with yarn 28 passing outwardly through guide arm 20 and yarn 30 passing outwardly through guide arm 21 through their respective outlets 34.

The weft sheet forming section 12 includes a pair of spaced thread support members 36 which supportably receive the threads or weft yarns 28 and 30 passing from the outlets 34 of the guide arms 20 and 21 in a plurality of generally parallel thread reaches therebetween. Thread support members 36 are of preferably substantially identical construction and each comprises an elongated helical member or spring 38 of high strength, rigid material such as spring steel. If desired, one of the thread support members 36 may use a double wound helical spring. The elongated helical member 38 is removably mounted in and rotable with a frusto-conical collar member 40 which facilitates placement of the thread or yarn in the spaces of the helical members 38 and is connected to rotably driven stub shaft 42. Stub shaft 42 is rotably mounted on the end of cross arm 44 which is supported by a suitable bearing surrounding the drive shaft 22. Each thread support member 36 is rotated about its horizontal axis. To facilitate positional support of the helical members 38, suitably supported blocks or stop members 46 are positioned beneath each helical member and abuttingly engage the same to prevent rotation of the cross arm 44 and helical member 38 about the shaft 22 during its rotation and thereby positionally stabilize the same.

As best seen in FIG. 1, the warp and weft sheet combining section includes a pair of nip rolls 48 and 50 which are rotably supported by suitable means, not shown, between the free or open ends of the helical members 38. As seen in FIG. 1, as the helical members 38 rotate to advance the thread or yarn reaches in spaced parallel relation therealong to form the weft sheet, the thread reaches leaving the open ends of the members 38 pass between and are engaged by nip rolls 48 and 50. One or more sheets 52 and 54 of warp threads or yarns from the warp beams 56 and 58, respectively, are supplied continuously to the nip portion of the rolls 48 and 50 from the beams and, during their movement therethrough, the warp and weft sheets are brought into contiguous coplanar relation. As shown in FIG. 1, the loop ends of the weft thread or yarn reaches are released from the rotating helical members 38 and the combined sheets pass over a guide roller 60 to the sheet securing section 16.

The securing section 16 includes an adhesive bath 62 through which the composite sheet of warp and weft yarns are passed by rotable squeeze rolls 64 and 66 to apply a suitable adhesive thereto. The sheet thereafter passes about the surface of a plurality of heated drying rolls 68 where the warp and weft yarns are secured together and the thus formed non-woven net fabric 70 is collected on a take-up roll 72. Although not shown, one or more of the rolls in the securing section 16 may be suitably driven to move the warp and weft sheets through the apparatus.

Looking again at FIG. 1, the stub shafts 42 and their respective helical members 38 have aligned central passageways through which selvage threads or yarns 73 continuously pass during formation of the weft sheet to be positioned within the loop ends of the weft thread or yarn reaches as the reaches leave the open ends of the helical members 38. The selvage threads not only strengthen the composite non-woven net fabric product 70 but provide additional support to the weft sheet during its passage through the securing section 16 of the apparatus.

As discussed briefly before, it is desired to run more than one weft strand so as to provide increased production and efficiency in the manufacture of non-woven fabric. In the preferred form of the invention the apparatus is shown running two strands of weft thread or yarn but it is understood that it is contemplated that any number of strands can be run within the scope of the invention. To this end and to reduce the overall length of the apparatus, the offset creel section 18 is employed. In conventional types of non-woven fabric producing machines the creel section would be located in direct line with the weft yarn laydown mechanism thus requiring the warp beams to be located beyond the creel section because of the ballooning of the weft yarn. In FIG. 2 it should be noted that the creel section 18 is offset from the rest of the apparatus allowing the warp beams 56 and 58 to move closer in toward the weft sheet forming section 12, thereby reducing the amount of floor space required to erect and operate the apparatus. This basically has been accomplished by utilizing a commercially available universal drive shaft transmission 75 between the sprocket 74, driven from the hollow shaft 22, and the shaft 76 to which is attached a sprocket 78 which transmits the drive to sprocket 79 via chain 80 to rotate hollow shaft 82 to which are attached radial hollow arms 84 and 86.

Creel section 18 is supported on a base plate 88 to which is attached an upright support 90 which rotably supports the hollow shaft 82, slidably supports the cage members 92 and 94 and the weft package support 96. The weft package support consists basically of a pair of plates 98 attached to the upright support 90 and support the rod 99 therebetween attached to the L-shaped arm 100. Rotably supported at the end of arm 100 is a shaft 102 to which is fixed a collar member 104 which rotates therewith and has a plurality of radially extending arms 106 to support the weft yarn packages 32. The packages 32 are connected to one another through the use of a transfer tail so that when one runs out the next package will automatically be unwound. This is accomplished by tying the tail of one package 32 to the lead end of the next adjacent package 32.

In operation continuous weft threads 28 and 30 are supplied from their respective packages 108 and 32, respectively, through the hollow shaft 22 to hollow guide arms 20 and 21 to wind the threads or yarns about the ends of the spaced-apart guide members 36. The threads or yarns 28 and 30 are guided by the frusto-conical member 40 into the spaces between the first and second helices of the springs 38. As the outlet ends 34 of the guide arms 20 and 21 pass about the springs 38, the threads or yarns 28 and 30 are laid in a plurality of reaches extending therebetween. The looped ends of the yarn engage the springs 38 and the springs are continuously rotated to advance the reaches in spaced, generally parallel relation along the springs to form the weft yarn sheet. As the reaches of the yarn 28 and 30 approach the open ends of the springs, they engage the selvage yarns passing through the center of springs 38 and combine with the warp threads 52 and 54 as they pass through nip rolls 48 and 50. As previously pointed out, the combined weft and warp thread sheets are then impregnated with a suitable adhesive, dried and cured and thereafter collected.

The thread or yarn 30 is delivered from the package 32 to the hollow shaft 22 through the hollow shaft 82 and the rotating hollow arm 84. The thread or yarn 28 is delivered to the hollow shaft 22 from the package 108 through the hollow nose portion 110, hollow shaft 82 and the radial hollow arm 86. To control the balloon configuration of the yarns 28 and 30 as they rotate, rings 112 and 114 are mounted on the housing of the transmission 75 by suitable supports 116 and 118.

Figure 3:
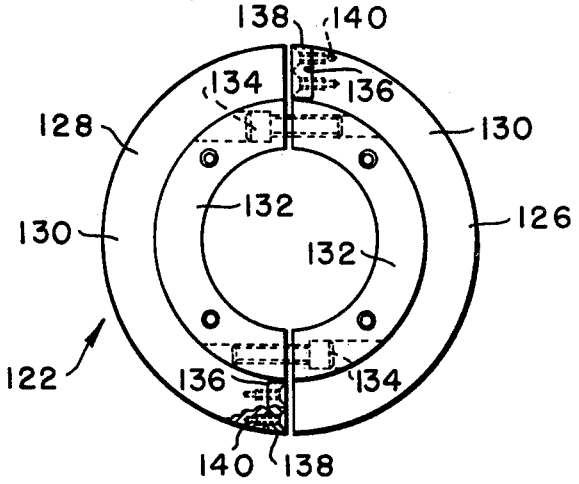
FIG. 3 is a front view of the magnetic timing disc used in conjunction with the improved stop motion.
Figure 4:
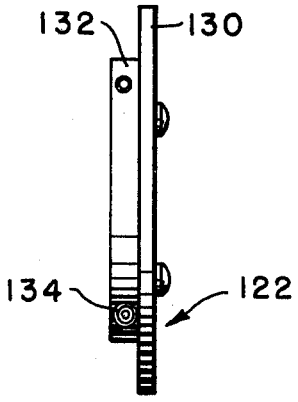
FIG. 4 is a side view of the timing disc shown in FIG. 3.
Figure 5:
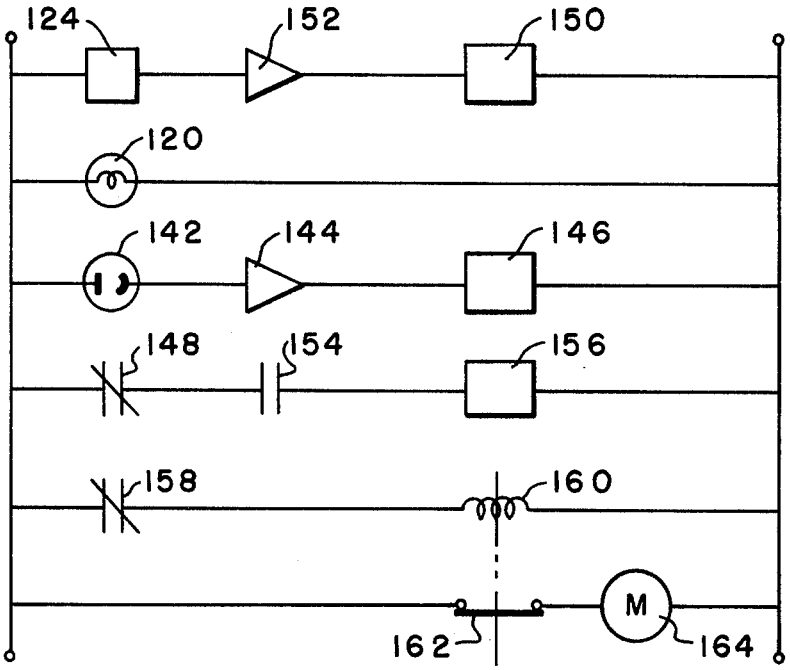
FIG. 5 is a schematic stop motion control circuit.

FIGS. 3-5 show in more detail the machine stop motion which is represented only partially in FIG. 1. FIG. 1 shows only the photocell light source 120 scanning the yarns 28 and 30, the timing disc 122 mounted on and rotating with the shaft 22 and the magnetic sensor 124 which picks up a signal from the timing disc 122.

The timing disc 122, shown in detail in FIGS. 3 and 4 consists of two semi-circular portions 126 and 128 each having a flange portion 130 and a collar portion 132 which mate together on the shaft 22 and are secured together by suitable screws 134. A notch 136 is located at one end of each portion 126 and 128 in which is secured a plate 138 of ferrous material, such as iron, by suitable screws 140. Preferably, the timing disc 122 is composed of a non-ferrous material such as aluminum while the plate 138 is a ferrous material. In the preferred form of the invention the plates 138 are located 180° apart from each other since we are detecting two weft yarns but, depending on the number of years being detected, the plates 138 will be located from each other a number of degrees equal to 360° divided by the number of ends to be detected.

Looking now to FIGS. 1, 2 and 5, and especially FIG. 5, the operation of the stop motion device will be explained. In setting up the machine the timing disc 122 is located on the shaft 22 so that the plate 138 is sensed by the magnetic sensing head 124 after the yarn end or the thread guide arms have passed the photocell light source 120.

Assuming now that the machine is threaded up and the arms 20 and 21 are rotating to lay down welt threads or yarn 28 and 30 the photocell light source 120 will send out a ray of light which will be reflected back by the yarn to the photocell 142, thereby passing a signal through the amplifier 144 to start the timer 146 to open the relay 148 for the length of time that the timer is adjusted for. In our particular case the timer will be set for a period less than the time for the arms 20 or 21 to rotate 180°. Then, since the timing disc 122 is so positioned that one of the plates 138 is sensed immediately after the scanning by the photocell, the magnetic sensor 124 will sense the plate 138 and send a signal to the timer 150 through the amplifier 152 to close the relay 154. Since the relay 148 is open, the timer 156 will not be actuated to open the relay 158 to deenergize the coil 160 to open the switch 162 to stop the motor 164. Depending on the number of yarns to be detected all the timers 150, 146 and 156 are set to time out in a period less than the time required for two successive yarns to be rotated pass the photocell or magnetic sensor so that the circuit will be automatically reset to detect each yarn as it rotates except when a broken end is detected.

When a broken end is detected by photocell arrangement the end will not be sensed by the photocell 142 so the relay 148 will remain closed. Then when the timing disc 122 rotates to a position where the plate 138 is detected by the magnetic sensor 124 the timer 150 will close the relay 154 to start the timer 156. The timer 156 will then open the relay 158 to open the circuit to the coil 160 to open the switch 162 to stop the motor 164 to stop the machine. The timer 156 will time out and the switch 162 will automatically be reset so the machine can be restarted manually by the operator. When the switch 162 has been automatically reset the end of yarn has been pieced up and the machine restarted by the operator, the stop motion device will operate as described above.

Although we have described specifically the preferred embodiment of our invention, we contemplate that changes may be made without departing from the scope or spirit of our invention and we desire to be limited only by the claims.

That which is claimed is:

1. Apparatus for producing non-woven fabric comprising: means to drive said apparatus, yarn guide means including a first pair of yarn guides spaced from one another, creel means for supporting a plurality of yarn packages, a hollow shaft member rotably supported in said apparatus, a plurality of radially directed yarn guide arms connected to shaft member, means operably associated with said creel means to supply yarn from said creel means through said hollow shaft member to said raidally directed yarn guide arms and to wind the yarn about said pair of spaced yarn guides to form reaches of yarn therebetween, a control circuit connecting said drive means to a source of power, a first means in operative relationship with said apparatus to break the control circuit to said drive means, a second means scanning the yarn between said yarn guide means and said yarn guides to allow said first means to break said control circuit to stop said drive means when a yarn break is detected, a third means operably associated with said control circuit and actuated after each scan by said second means to energize said first means upon the detection of a yarn break by said second means and means for combining a sheet of yarns with the yarn reaches between said first pair of spaced yarn guides to form a non-woven fabric, said third means including a ferrous material operably associated with said rotatable yarn guide means, a magnetic sensing means, a first timer to reset the circuit to said drive means when said first timer has timed out, a time controlled switch in operative relationship with said first timer and a second timer activated by said magnetic sensing means to close the circuit to said first timer when said ferrous material is sensed by the magnetic sensing means.

2. Apparatus for producing non-woven fabric comprising: means to drive said apparatus, yarn guide means including a first pair of yarn guides spaced from one another, creel means for supporting a plurality of yarn packages, a hollow shaft member rotably supported in said apparatus, a plurality of radially directed yarn guide arms connected to shaft member, means operably associated with said creel means to supply yarn from said creel means through said hollow shaft member to said radially directed yarn guide arms and to wind the yarn about said pair of spaced yarn guides to form reaches of yarn therebetween, a control circuit connecting said drive means to a source of power, a first means in operative relationship with said apparatus to break the control circuit to said drive means, a second means scanning each yarn between said yarn guide means and said yarn guides to allow said first means to immediately break said control circuit prior to the completion of a revolution of said guide arm to immediately stop said drive means when a yarn break is detected to prevent the production of a flaw in the non-woven fabric being produced, a third means operably associated with said control circuit and actuated after each scan by said second means to energize said first means upon the detection of a yarn break by said second means and means for combining a sheet of yarns with the yarn reaches between said first pair of spaced yarn guides to form a non-woven fabric.

3. The apparatus of claim 2 wherein said third means includes a ferrous material operably associated with said rotable yarn guide means and a magnetic sensing means.

4. The apparatus of claim 3 wherein said ferrous material includes at least two plates mounted in a collar member, said collar member being fixed to and rotating with said hollow shaft member.

5. The apparatus of claim 4 wherein said third means also includes a first timer to reset the circuit to said drive means when said first timer has timed out.

* * * * *